United States Patent [19]

Kaufman

[11] Patent Number: 4,977,884

[45] Date of Patent: Dec. 18, 1990

[54] FAIL-SAFE BLOWER DRIVE FOR ROOF MOUNTED KITCHEN HOOD GREASE EXHAUST BLOWERS

[75] Inventor: Arnold S. Kaufman, Studio City, Calif.

[73] Assignee: Renco Systems, Inc., Glendale, Calif.

[21] Appl. No.: 475,246

[22] Filed: Feb. 5, 1990

[51] Int. Cl.[5] ..... F24C 15/20

[52] U.S. Cl. ..... 126/299 R; 126/299 D; 98/115.1; 411/122

[58] Field of Search ..... 126/299 D, 299 R, 299 F; 165/53, 120; 98/115.3, 115.1; 416/60, 122

[56] References Cited

U.S. PATENT DOCUMENTS

| | | | |
|---|---|---|---|
| 1,902,411 | 3/1933 | McCarthy | 126/299 F |
| 2,878,991 | 3/1959 | Berman | 416/121 |
| 4,200,087 | 4/1980 | Welsh | 126/299 R |
| 4,462,387 | 7/1984 | Welsh | 126/299 R |
| 4,676,144 | 6/1987 | Smith, III | 98/115.3 X |

*Primary Examiner*—Larry Jones

*Attorney, Agent, or Firm*—Beehler & Pavitt

[57] ABSTRACT

A roof mountable kitchen grease exhaust blower is constructed with hinged housing elements which can be raised for easy service access to all parts of the unit. Redundant blower drive motors are provided either of which can be easily engaged to the blower wheel in the event of failure of the other. A blower wheel drive belt is equally engageable to either drive motor and change-over from one to the other is easily and quickly made by minimally skilled personnel. The newly engaged drive motor is enabled by a power select switch at the blower control panel.

10 Claims, 3 Drawing Sheets

FAIL-SAFE BLOWER DRIVE FOR ROOF MOUNTED KITCHEN HOOD GREASE EXHAUST BLOWERS

BACKGROUND OF THE INVENTION

1. Field of the Invention

This invention generally relates to the field of air ventilation systems and more particularly is directed to certain improvements in roof mounted exhaust blowers of the type used with kitchen hoods in commercial kitchens for removing smoke and grease laden air over cooking surfaces.

2. State of the Prior Art

Commercial kitchens, such as in restaurants and fast food outlets, frequently have a ventilation hood over stoves, grills, broilers and the like for collecting and exhausting the smoke and fumes generated by cooking processes. Hot grease-laden air rises into the hood, and is drawn into a duct by means of a motor driven blower mounted on the kitchen roof or adjacent area. The contaminated air is exhausted to the outdoors. Such installations are typically required by local ordinance and are therefore in widespread use. There are different manufacturers of such equipment and designs for the exhaust blowers vary in various details and features from one manufacturer to another, although the general mode of operation is similar.

The grease exhaust system in a commercial kitchen is essential to the operation of the establishment because of the considerable quantities of hot, grease laden, smoky and polluted air generated by large volume cooking processes. Unless the atmosphere over the stoves, broilers, grills etc. is continuously vented to the exterior, the kitchen interior will in many cases fill with smoke in a short time and bring to a stop further work in that environment. Most kitchen ventilation systems typically depend on a single electric motor which drives the blower wheel in the roof or otherwise exteriorly mounted exhaust blower to draw the polluted air from the kitchen interior. In the event of failure of this drive motor, kitchen operations must effectively cease until repair can be made, bringing the eating establishment to a close for the duration. Since most other components of the ventilation system are passive, e.g., the sheet metal hood, ducts, and filters, the reliability of the system is in good measure related to the reliability of the blower drive, and in particular, the blower drive motor. The loss of business and customer goodwill resulting from a forced shut-down of kitchen services can be considerable, and in many locations prompt repair is not possible, particularly at night and holidays, which are peak business periods for many eating establishments.

A continuing need therefore exists for enhancements in the reliability of kitchen exhaust blower drives, particularly enhancements which provide fail-safe back-up in the event of drive failure.

SUMMARY OF THE INVENTION

The grease exhaust blower of this invention features a number of improvements which collectively serve to substantially improve access to all parts of the blower unit, increase the unit's reliability and significantly reduce the accumulation of condensed grease on the roof top surface adjacent to the blower unit.

More specifically, this invention is a roof mountable kitchen grease exhaust blower having a base which communicates through an exhaust air duct with a kitchen ventilation hood for extracting grease laden air over a cooking surface, a blower housing hinged to the base for movement between a closed operative position and a raised maintenance position, a discharge scoop fixed to the blower housing, and a blower wheel supported in the blower housing for exhausting air from the base through the scoop. The blower wheel is supported in a motor housing hinged to the blower housing for movement between a closed operative position and an exposed maintenance position. In one form of the invention first and second motors are mounted to the motor housing, and a drive belt is equally engageable to one or the other of the motors for driving the blower wheel, and a power switch selects power to one of the motors, whereby a backup motor can be readily placed in service for driving the blower in the event of failure of the other one of the two motors.

The motor housing is hinged to the blower housing such that the motors are cantilivered and at least partially balance the weight of the blower wheel for easier tilting of the motor housing to the exposed maintenance position.

DETAILED DESCRIPTION OF THE PREFERRED EMBODIMENTS

Figure 1:
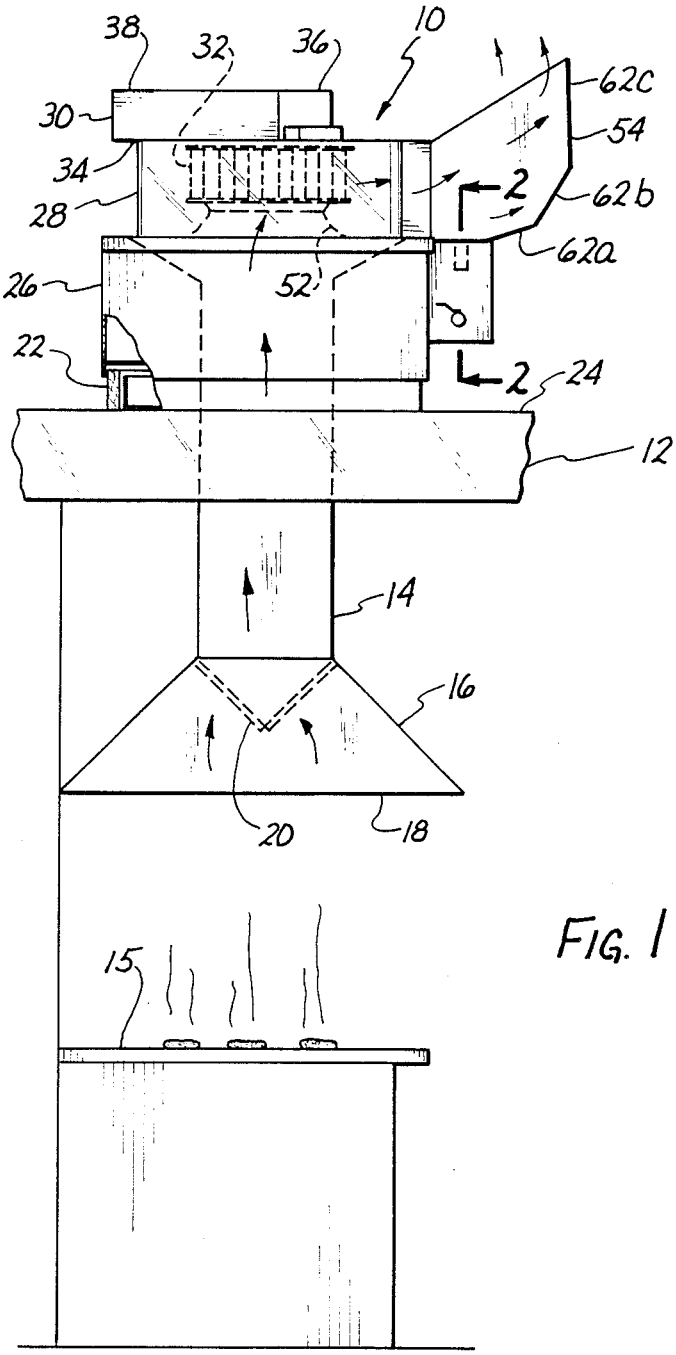
FIG. 1 is an elevational diagrammatic view of a typical kitchen hood/exhaust installation using the improved exhaust blower unit of this invention.
Figure 2:
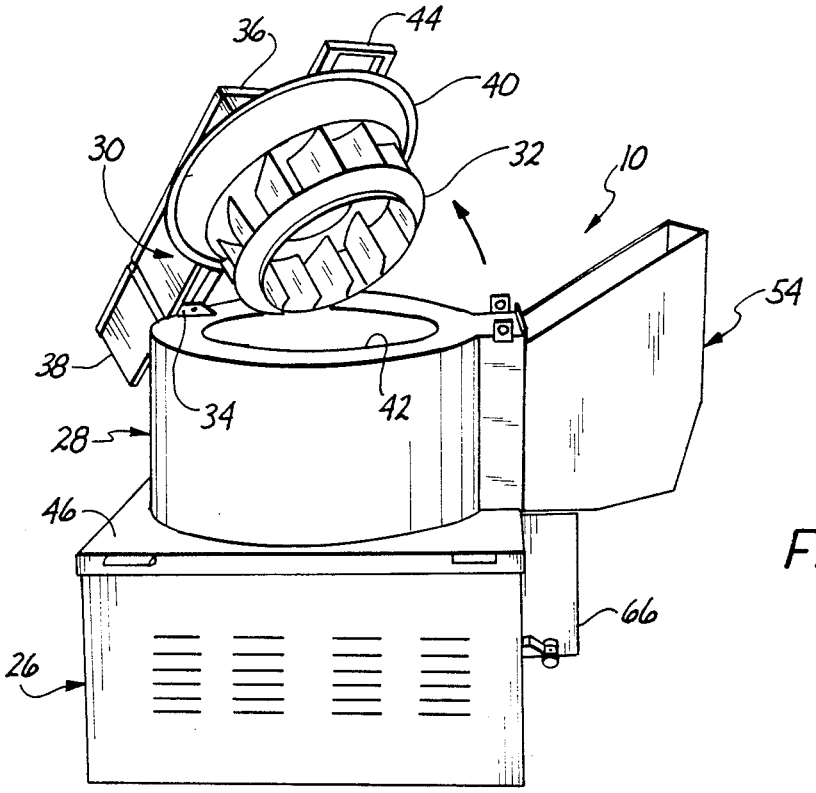
FIG. 2 is a perspective view of the improved exhaust blower unit showing the tilt-out blower wheel raised to its service access position.

With reference to the drawings, FIG. 1 shows a typical commercial kitchen installation with an exhaust blower unit 10 mounted on a kitchen roof 12 and connected with a kitchen hood 16 via an exhaust duct 14 which passes through an opening in the roof 12. The hood 16 overlies a cooking surface 15 such as a grill, broiler, stove or any other cooking equipment likely to produce undesirable fumes and grease laden air which require venting from the kitchen interior. The kitchen hood 16 is not described in detail as various designs for such hoods are in use and are often tailored to the particular requirements of each installation. Generally, the hood 16 has open underside 18 into which air is drawn upwardly as suggested by the flow arrows in FIG. 1. The airflow passes through filters 20 and into the exhaust duct 14.

The roof mounted blower unit 10 is usually set on a raised, rectangular curb 22 which encloses the duct opening in the roof. The construction of curbs for installation of this type of equipment is well-known in the trade, since similar curbs are used for installation of air conditioning equipment and the like as well. Briefly, the curb is a wooden or steel rectangular frame on the roof surface 24 and is covered with weather-proofing material to prevent seepage of rain water into the duct opening.

Figure 3:
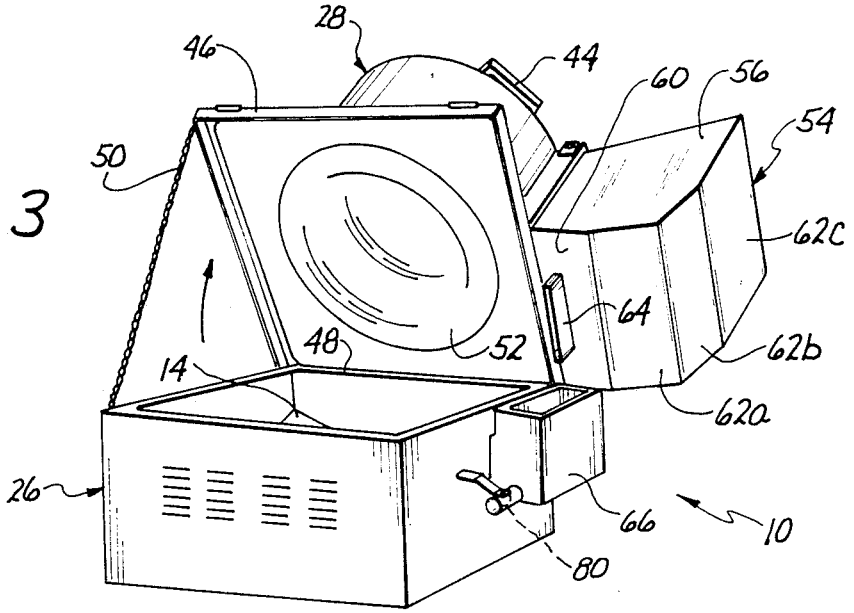
FIG. 3 is a perspective view of the blower unit of FIG. 3, shown with the blower housing raised for access into the base and the duct leading to the kitchen hood below.
Figure 4:
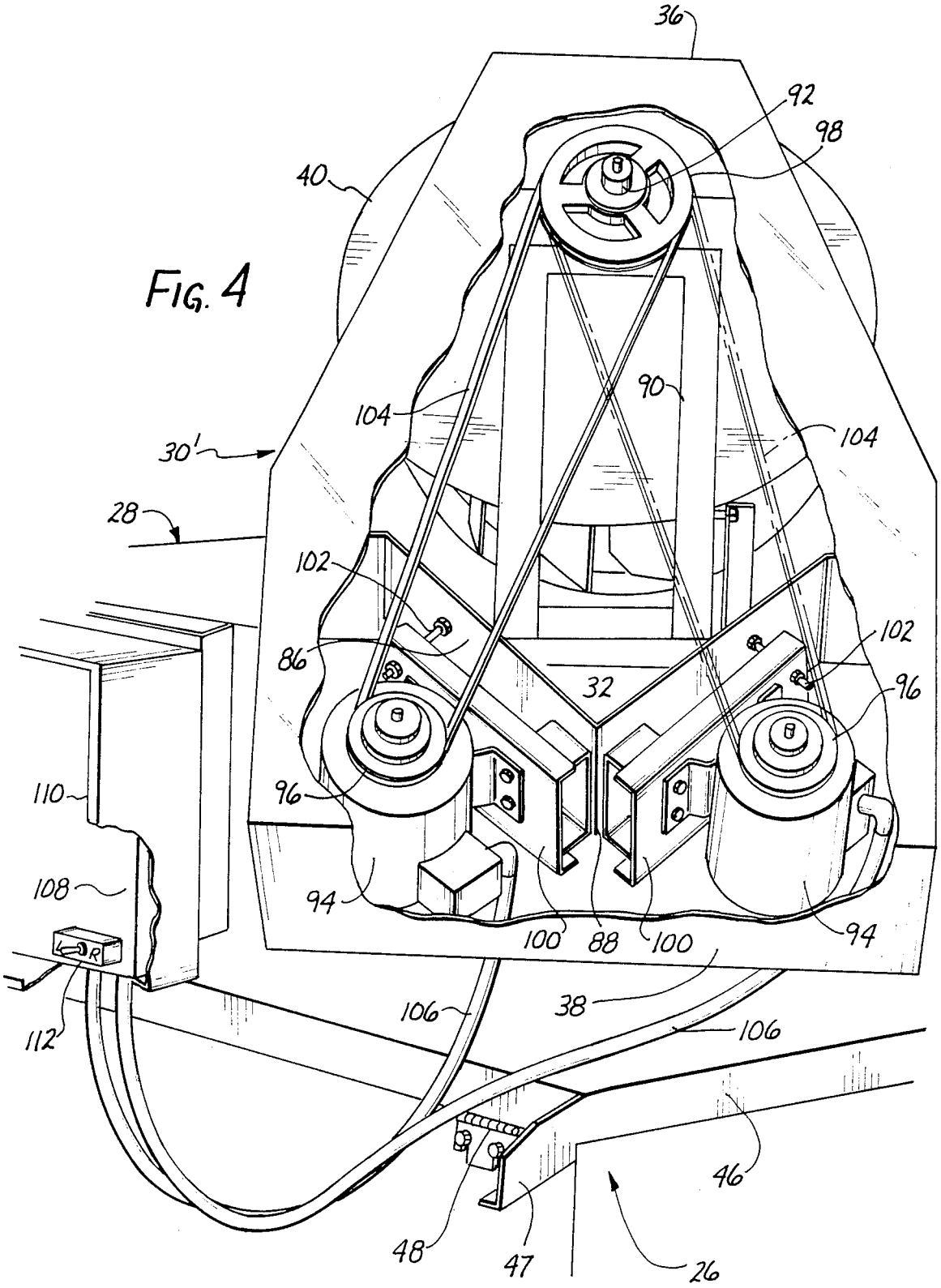
FIG. 4 is a fragmentary perspective view of the blower unit showing the redundant drive motor feature.

The blower unit 10 includes three stacked sub-units: a base 26, a blower housing 28, and a weather-proof motor housing 30, as shown in FIGS. 3 and 4. In FIG. 1, the three sub-units 26, 28 and 30 are shown in normal operative position for drawing air from the duct 14 and exhausting it to the atmosphere. A centrifugal blower wheel 32 is mounted for rotation inside the motor housing 30, which is a generally elongated rectangular sheet metal box. The motor housing 30 is hinged at 34 to the blower housing 28 so that part of the motor housing is cantilevered and extends unsupported over the edge of the blower housing. The blower wheel 32 is mounted near the inner end 36 of the motor housing 30 while the drive motor (not shown in FIGS. 1–4) is mounted near the outer, cantilevered end 38. The drive motor is connected by a drive belt to a pulley mounted on the shaft of the blower wheel 32. The weight of the drive motor serves to balance, at least in part, the weight of the blower wheel 32. This balancing makes it easier to lift up the inner end 36 of the motor housing which carries the blower wheel 32. In the normal, operative position of FIG. 1 the blower wheel is contained within the blower housing 28. When the motor housing is lifted to the raised access position shown in FIG. 3 the blower wheel 32 is lifted through a circular opening 42 in the top of the blower housing 28 and is fully exposed for easy cleaning and inspection. A circular cover 40 is fixed to the underside of the motor housing 30 and serves to close off the circular opening 42 once the blower wheel has been lowered into the blower housing. A handle 44 is attached to the inner end 36 of the motor housing for use in lifting the same.

The blower housing 28 is supported on a lid 46 hinged along edge 48 to the base 26. The lid can move between a closed operative position shown in FIG. 3 and an open position shown in FIG. 4 which allows easy access into the base and also into the upper end of the exhaust duct 14 which is enclosed by the base 26. While the unit is being serviced a support chain 50 holds the lid 46 in the open, elevated position of FIG. 4 against the weight of the motor housing and blower which are so arranged on the lid as to pull the lid towards a fully open position. The lid 46 also has a support stop 47 extending from the hinged side of lid 46 as shown in FIG. 5 which limits the opening of the lid. An intake funnel 52 is fitted into a circular central opening of the lid 46 and directs air into the center of the blower wheel 32 in the blower housing 28, as suggested in dotted lining in FIG. 1. The air is then driven radially to the exterior of the wheel into the blower housing 28 from which it must exhaust through the discharge duct 54. As can be seen, the base 26, blower housing 28 and motor housing 30 are hinged to each other as explained and allow nearly unrestricted access to all parts of the exhaust blower unit 10 for thorough cleaning, frequent inspection and easy maintenance.

The discharge scoop 54 shown in FIGS. 1, 3, 4, and 6 deflects the horizontal exhaust from the blower housing 28 upwardly, as indicated by the flow arrows in FIGS. 1 and 6. The scoop 54 is constructed of sheet metal and has two vertical side walls 56 connected by a curved bottom or end wall 58. As best seen in FIGS. 1 and 4, the scoop wall 58 is assembled as a series of rectangular panels, starting at a horizontal panel 60 adjacent to the blower housing 28 and progresses through two intermediate incrementally angled panels **62*a*, 62*b* to a vertical end panel 62*c***.

The incrementally sloped panels comprising the scoop wall 58 define a reflux gradient for returning grease deposited on the inner surfaces of the scoop by the exhaust air stream to the inner panel 60 and drain slot 64. A grease container 66 is mounted to the side of the base 26 underneath the scoop drain slot 64. All material draining from the scoop through the slot 64 is collected in this container. The container 66 is a box with an open top which is covered by the bottom panel 60 of the exhaust scoop when the blower housing is in the lowered operative position of FIG. 3. When the blower housing is raised as in FIG. 4, the top of the container 66 is open.

Turn now to FIG. 5 which shows an alternate motor housing 30' fitted to the exhaust blower unit 10 such as in FIG. 1. The motor housing is seen from its outer, cantilevered end 38 with the inner end 36 raised away from the blower housing 28, and is broken open to show the interior. A V-bracket 86 is fixed transversely to the housing 30', with the apex 88 of the V pointing away from the blower wheel 32 and centered along the longitudinal axis extending between the two ends 38 and 36 of the motor housing 30'. A support frame 90 is welded to the motor housing 30' and has a bearing at its inner end in which is journaled the blower shaft 92. Two drive motors 94 are mounted to the V bracket 86, one on each side of the apex 88, such that the drive pulleys 96 of each motor are equidistant from a driven pulley 98 on the blower wheel shaft 92. Each motor 94 is mounted on a base plate 100 which in turn is mounted to the corresponding side of the V bracket 86. A limited adjustment of the spacing between the base plate 100 and the bracket 86 can be achieved by means of threaded mounting bolts 102. Each electric motor 94 is connected by a corresponding power cord 106 to a power control panel 108 enclosed in box 110 mounted to the blower housing 28. The control panel 108 is in turn connected to a suitable source of electrical power (not shown). The control panel 108 includes a motor-select switch 112 which can be toggled between left and right positions for selectively directing electric power through appropriate magnetic starters to only one or the other of the two motors 94 at any given time. The switch 112 will normally be used to select that motor 94 which is connected to the blower wheel pulley 98 by the drive belt 104. If the currently selected drive motor 94 were to fail, the blower wheel 32 will cease to operate, a condition which would quickly become apparent to personnel in the kitchen since smoke would no longer be vented from the kitchen hood. A commercial kitchen cannot operate for any significant length of time under such circumstances and the establishment would essentially be forced to shut down until qualified service personnel could be brought in with a suitable replacement motor and a repair made. Thus could take several hours time and in some cases even days if the location is remote and service personnel or parts are not available in the vicinity. The dual motor system of FIG. 6 avoids this predicament by making immediately available as a back-up a second drive motor 94 already properly mounted and fitted with a drive pulley 96. In the event of failure of one drive motor 94, the repair merely involves disengaging the drive belt 104 from the currently engaged drive pulley 96 and fitting belt 104 to the drive pulley 96 of the alternate, heretofore idle motor 94. This is a very simple operation which can be carried out by minimally trained personnel in a matter of minutes. The repair is completed by toggling the motor-select switch 112 to apply power to the alternate motor 94 which is now able to drive the blower wheel 32. The alternate or back-up position of the drive belt 104 is indicated in phantom lining in FIG. 5. The motor housing 30′ of FIG. 5 differs from the motor housing 30 of FIGS. 1, 3 and 4 only in that it has been widened somewhat to accommodate the V-bracket 86 and the two drive motors 94 side by side. In the motor housing 30, only one drive motor 94 is provided, but the belt and pulley arrangement is similar to that shown and described in FIG. 5.

The preferred embodiments of the invention have been shown and illustrated for purposes of clarity and example only, and it will be understood that many changes, substitutions and modifications to the described embodiments will become readily apparent in light of the foregoing description to those possessed of ordinary skill in the art without thereby departing from the spirit and scope of the present invention which is defined by the following claims.

What is claimed is:

1. A roof mountable kitchen grease exhaust blower comprising:

a base for supporting an upper end of an exhaust duct communicating with a ventilation hood for extracting grease laden air over a cooking surface;

a blower housing hinged to said base for movement between a closed operative position and a raised maintenance position;

a discharge scoop fixed to said blower housing;

a blower wheel supported in said housing for exhausting air from said base through said scoop;

said blower wheel supported in a motor housing hinged to said blower housing for movement between a closed operative position and an exposed maintenance position; and drive means for turning said blower wheel comprising first and second motors mounted to said motor housing, a drive belt equally engageable to one or the other of said motors for driving said blower wheel, and power switch means for selectively powering one of said motors, whereby a backup motor can be readily placed in service for driving said blower in the event of failure of one of said motors.

2. The blower of claim 1 wherein said motor housing is hinged such that said motors are cantilevered and at least partially balance the weight of said blower wheel for easier tilting of the motor housing to said exposed maintenance position.

3. A roof mountable kitchen grease exhaust blower comprising:

a blower housing adapted to communicate with a ventilation hood arranged for extracting grease laden air over a cooking surface;

a blower wheel in said housing for exhausting air from said hood to the atmosphere;

drive means for turning said blower wheel comprising first and second motors mounted to said motor housing, a drive belt equally engageable to one or the other of said motors for driving said blower wheel, means for mounting said first and second motors in positions with respect to said blower wheel to allow engagement of either motor by said drive belt, and power switch means for selectively powering one of said motors, whereby a backup motor can be readily placed in service for driving said blower wheel in the event of failure of one of said motors.

4. A roof mountable kitchen grease exhaust blower comprising:

a blower housing adapted to communicate with a ventilation hood arranged for extracting grease laden air over a cooking surface a blower wheel in said housing for exhausting air from said hood to the atmosphere;

drive means for turning said blower wheel comprising first and second motors mounted to said motor housing, each motor having a drive pulley, a driven pulley for driving said blower wheel, a drive belt equally engageable between said driven pulley and either of said drive pulleys, and power switch means for selectively powering one of said motors, whereby a backup motor can be readily placed in service for driving said blower wheel in the event of failure of one of said motors.

5. The device of claim 4 wherein said motors are mounted on corresponding sides of a V-shaped bracket fixed to said motor housing such that said drive pulleys are equidistant to said driven pulley.

6. A roof mountable kitchen grease exhaust blower comprising:

a base communicating with an upper end of an exhaust duct connected with a ventilation hood for extracting grease laden air over a cooking surface;

a blower housing hinged to said base for movement between a closed operative position and a raised maintenance position;

a discharge scoop fixed to said blower housing;

a blower wheel supported in said housing for exhausting air from said base through said scoop;

said blower wheel supported in a motor housing hinged to said blower housing for movement between a closed operative position and an exposed maintenance position; and drive means for turning said blower wheel comprising first and second motors mounted to said motor housing, a drive belt equally engageable to one or the other of said motors for driving said blower wheel, and power switch means for selectively powering one of said motors, whereby a backup motor can be readily placed in service for driving said blower in the event of failure of one of said motors.

7. The blower of claim 6 wherein said motor housing is hinged such that said motors are cantilevered and at least partially balance the weight of said blower wheel for easier tilting of the motor housing to said exposed maintenance position.

8. The device of claim 6, each said motor having a drive pulley, a driven pulley for driving said blower wheel, said being drive belt equally engageable between said driven pulley and either of said drive pulleys.

9. The device of claim 8 wherein said motors are mounted on corresponding sides of a V-shaped bracket fixed to said motor housing such that said drive pulleys are equidistant to said driven pulley.

10. A roof mountable kitchen grease exhaust blower comprising:

a base communicating with an upper end of an exhaust duct connected with a ventilation hood for extracting grease laden air over a cooking surface;

a blower housing hinged to said base for movement between a closed operative position and a raised maintenance position;

a discharge scoop fixed to said blower housing;

a blower wheel supported in said housing for exhausting air from said base through said scoop;

a cantilevered motor housing hinged to said blower housing;

said blower wheel having a driven pulley and supported for movement with said motor housing between a closed operative position and an exposed maintenance position; and first and second motors mounted to opposite sides of a V-shaped bracket fixed to said motor housing, each motor having a drive pulley equidistant from said driven pulley, a drive belt equally engageable between said driven pulley and one or the other of said drive pulleys for driving said blower wheel, and power switch means for selectively powering one of said motors, whereby a backup motor can be readily placed in service for driving said blower wheel in the event of failure of one of said motors, said motors arranged so as to at least partially balance the weight of said blower wheel to facilitate said movement of said motor housing.

* * * * *